United States Patent [19]

Dietrich

[11] 4,272,873

[45] Jun. 16, 1981

[54] STONE ROLLER

[75] Inventor: Robert Dietrich, Heidenheim-Grosskuchen, Fed. Rep. of Germany

[73] Assignee: J. M. Voith GmbH, Fed. Rep. of Germany

[21] Appl. No.: 32,920

[22] Filed: Apr. 24, 1979

[30] Foreign Application Priority Data

Apr. 27, 1978 [DE] Fed. Rep. of Germany ..... 2818437

[51] Int. Cl.[3] ..... D21F 3/08

[52] U.S. Cl. ..... 29/123; 29/125; 29/129.5; 29/132

[58] Field of Search ..... 29/123, 125, 129.5, 29/132

[56] References Cited

U.S. PATENT DOCUMENTS

| | | | |
|---|---|---|---|
| 1,737,117 | 11/1929 | Morton | 29/125 UX |
| 1,982,628 | 12/1934 | Benner et al. | 29/123 UX |
| 2,135,175 | 11/1938 | Fallon | 29/125 UX |
| 2,693,670 | 11/1954 | Perry | 29/123 UX |
| 3,737,962 | 6/1973 | Hill | 29/123 |

FOREIGN PATENT DOCUMENTS

| | | | |
|---|---|---|---|
| 827094 | 1/1952 | Fed. Rep. of Germany | 29/125 |
| 820902 | 9/1959 | United Kingdom | 29/125 |

*Primary Examiner*—Werner H. Schroeder

*Attorney, Agent, or Firm*—Ostrolenk, Faber, Gerb & Soffen

[57] ABSTRACT

The disclosure concerns a stone roller for use in a paper making machine as a pressure roller, or for other like uses. The stone roller may be comprised of granite. To prevent roller cracking and sagging, it is axially stressed by clamping plates at opposite ends. A plurality of tie-rods preferably placed closer to the periphery than the axial center of the roller, pass through the roller and join and draw together the clamping plates so as to axially stress the body. Either a single large diameter borehole or a plurality of boreholes are provided in the roller body, through which the tie-rods pass. The open space in the boreholes may be filled with a filler, such as concrete. To protect the tie-rods from abrasion, they may be covered by a protective sheath of plastic or rubber. In an alternate form, the stone roller body may be comprised of an axial series of roller body parts, having complementary formations on their adjoining faces for properly relatively positioning them.

22 Claims, 3 Drawing Figures

STONE ROLLER

BACKGROUND OF THE INVENTION

The present invention relates to stone rollers, particularly for paper making machines. Such a roller includes a roller body of stone with clamping plates arranged at its axial ends, and the plates are connected to each other through the roller body and hold the body under axial stress. An example of such a roller can be found in U.S. Pat. No. 3,737,962.

Stone rollers of this type are used particularly as press rolls in the press sections of paper machines. However, they may also be used in other sections of the paper machines, for instance in the dry end or in calenders.

The body of the roller is normally comprised of granite. In operation, the stone roller rests with a predetermined pressure against a counter-roller. As a result, the stone roller, which is several meters long, is stressed in flexure between its end support points. In order to prevent the stone body from breaking apart, it is clamped between clamping plates arranged at its ends. For the clamping purpose, an axial tie-rod positioned at the middle or axis of the roller is used to draw the clamping plates together. The tie-rod is given an initial static stress, usually a few hundred t (150–1200 t). 1 ton=1000 kg. oscillating load, which derives from the forces of reaction of the rotating roller on its end supports. The traditional construction of a stone roller therefore requires a correspondingly large tie-rod of very great weight which must be manufactured as a special forged part for each roller.

Tie-rods placed at the center of the roller could have much smaller cross-sections if they only had to transmit the initial static stress. But, experience has shown that these tie-rods break during operation since they receive an additional alternating load from flexing forces. Breaking of the tie-rods usually occurs at places having notches, and, therefore occurs at the clamping threads on the rods. These difficulties have previously been eliminated by making the cross-sections of the single centrally disposed tie-rods considerably larger. But, this has resulted in greater weight and higher expenses.

In addition, the steel clamping plates which transmit the initial force from the tie-rod to the stone roller, at the ends of the roller, must usually be very thick since they have to take up a high bending or inversion moment. The thickening of the plates has the disadvantage that for the stone roller, there is an even greater distance between the end supports than with customary rollers of a paper machine. The tie-rod can additionally be surrounded by filler material in the borehole which contains it.

Another type of known roller that uses a tie-rod is the drying cylinder of a paper machine, as shown in U.S. Pat. No. 2,576,036 and West German Provisional Patent (Auslegeschrift) 1,160,723. Here, the tie-rod serves merely to relieve the cylinder heads which are acted on by steam pressure.

SUMMARY OF THE INVENTION

It is an object of the invention to develop stone rollers that are cheaper to manufacture and can be arranged so that there is the same distance between the end supports for the stone rollers as for other rollers of the machine, e.g. the paper machine.

It is another object of the invention to avoid unintentional loosening of the tie-rod by making the roller less sensitive to the flexing forces of use and by more effectively suppressing oscillations than in known rollers of this type.

According to the invention, the clamping plates at the axial ends of the roller body are connected to each other by a plurality, of at least two, tie-rods, which act at different points on the clamping plates. The tie-rods are all at a predetermined distance, which is as large as possible, from the radial center of the roller. The tie-rods are preferably symmetrically spaced annularly around the roller body and are preferably at the same radial positions in the roller body.

In contrast to a single tie-rod disposed at the axis of the roller body, if the plurality of tie-rods are shifted toward the outside or peripheral surface of the stone roller, then only an oscillating load in the axial direction occurs, while the flexing of the roller has practically no influence. Therefore, tie-rod cross-sections can be reduced so much that a reduction in weight by a factor of 8 to 12, as compared with a single centrally disposed tie-rod, is possible. Furthermore, the forged special construction now required for tie-rods can be dispensed with in favor of the tensioning steels customary in reinforced concrete construction. In addition, the end clamping plates can be made thinner in their axial dimensions, whereby the desired normal distance between the end supports of the roller body is obtained.

One reason for the initial stressing of the stone roller is so that dangerous oscillations can only take place if the roller is able by its design to oscillate. Oscillations produce sagging of the roller. Since such sagging is substantially avoided by radially outward shifting of the tie-rods, roller oscillations are also effectively suppressed according to the invention.

The tie-rods extend axially through the roller body, through axial boreholes formed in the body of the roller, and they extend substantially parallel to the axis of the roller. The tie-rods are most effective if they are shifted as far as possible radially outwardly to near the outer periphery of the roller. The tie-rods are preferably symmetrically arranged.

It is difficult to make stone rollers of a length of several meters. Obtaining a single piece, long length rough stone body in a quarry, working the rough body into a roll body, and finally, producing the boreholes, which may have to extend through non-homogeneous material, all entail a high risk with respect to the costs incurred. It may particularly be difficult to produce a roller by the delivery date guaranteed by the manufacturer of the machine. In order to reduce this risk, the stone is divided into several individual pieces. The individual pieces are provided with complementary profilings at their axial ends in order to guarantee the radial position of the individual pieces with respect to each other.

The tie rods can, in known manner, be embedded in filler material in the boreholes. In this way, corrosion and oscillations of the tie-rods are avoided. Concrete may be used as filler. Plastic or an elastic intermediate layer between the tie-rod and concrete filler also may be used.

The bending of the rotating roller can produce relative movement between the tie-rod and stone on the order of magnitude of μm. These movements can produce scraping of the surfaces of the tie-rod. A fatigue fracture could result from an abraded surface, particularly in the case of materials that are subjected to high heat treatments, since heat-treated material does not have the ability to "cure" flows as is the case of mild forging steel (370 $N/mm^2$–500 $N/mm^2$)

Other objects and features of the invention are described below with reference to the accompanying drawings.

DESCRIPTION OF THE PREFERRED EMBODIMENTS

Figure 1:
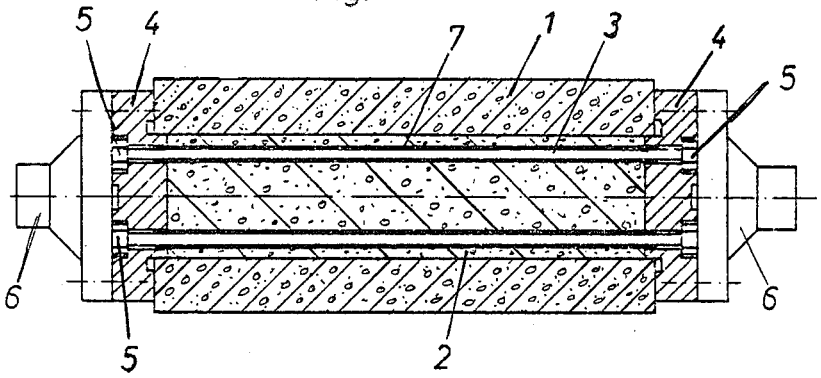
FIG. 1 is an axial cross-sectional view through a stone roller embodiment according to the invention, having a central axial borehole and plural tie-rods.

Referring to FIG. 1, it shows a roller body 1 consisting of stone, for instance granite. An axial borehole 2 of relatively large cross-section is formed in the roller body. Several tie-rods 3 extend through the borehole 2, and all are placed relatively far radially toward the outside of the roller. The tie-rods are placed symmetrically around the roller body. The tie-rods extend through holes in and connect together the end clamping plates 4. The tie-rods are held by the nuts 5 which clamp the clamping plates 4 against the ends of the roller body 1. Tie-rods 3 and nuts 5 are commercially available parts.

In order to avoid corrosion and oscillations of the tie-rods 3, they are embedded in filler material, for instance, concrete. The filler is introduced into the borehole 2 after the clamping of the clamping plates by the tie-rods 3. The tie-rods 3 are surrounded by a cover 7 of plastic, rubber, or the like, to protect the rods from scraping against the concrete filler and/or the stone of the roller body.

In this embodiment, journals 6 are screwed onto the clamping plates 4, which enable the roller to rotate easily and provide end supports for the roller.

Figure 2:
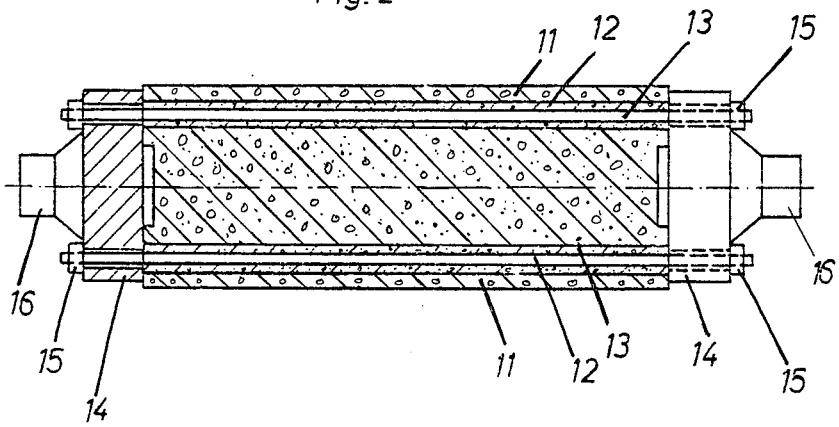
FIG. 2 is an axial cross-sectional view through another stone roller embodiment of the invention, having several longitudinally extending boreholes.

In the roller embodiment of FIG. 2, the clamping plates and journals are respectively developed in a single piece. The roller body 11, also consists of stone, for instance granite. Near the outer periphery of the roller, a plurality of annularly spaced part longitudinally extending, relatively small cross-section, symmetrically arranged boreholes 12 are formed. A tie-rod 13 extends through each borehole. Nuts 15 screwed onto the ends of the tie-rods 13 clamp the clamping plates 14 against the ends of the roller body 11. Hollow spaces between the tie-rods 13 and the walls of the boreholes 12 can also be filled with filler.

The further radially outward the position of tie-rods, the thinner the clamping plates 4 and 14 may be, since they can no longer be as strongly bent or deformed by the tie-rods.

Figure 3:
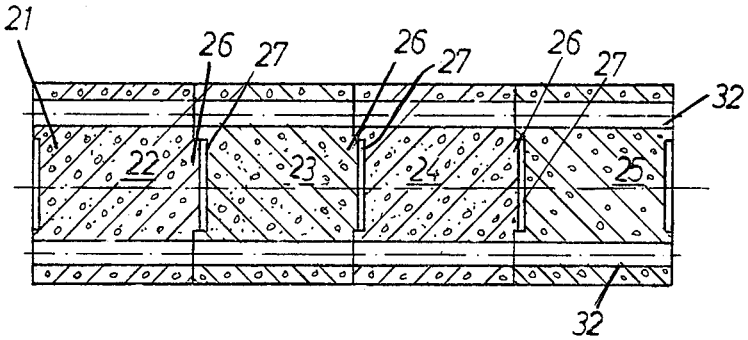
FIG. 3 is an axial cross-sectional view through a part of still another embodiment of stone roller, having a subdivided roller body.

FIG. 3 shows a roller body 21 formed of stone which is comprised, for instance, of four originally separate parts 22, 23, 24 and 25, arranged axially one behind the other. Individual stone parts 22, 23, 24, 25 are easier to machine and can be obtained with less risks than an individual stone of a length of several meters.

At one end of each part, there is a pin-like projection 26 which engages a corresponding complementary recess 27 on the opposite end of the adjacent roller-body part. This positive connection between neighboring roller parts produces precise alignment and stability of the entire roller body. Radially spaced from the axis of the roller and near the outer periphery of the roller, a plurality of longitudinal annular spaced apart, preferably symmetric boreholes 32 are formed to receive tie-rods (not shown) corresponding to the tie-rods 13 of FIG. 2. Before the tie-rods are installed, the stone parts are rotated so that their corresponding boreholes are axially aligned. The profiling 26, 27 at the ends of the parts can be shaped so that the boreholes will be aligned through all of the roller body parts.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A stone pressure roller for a paper making machine comprising:

a unitary cylindrical roller body comprised of stone; said roller body having opposite axial ends;

a respective clamping plate positioned at each said axial end of said roller body;

a plurality of tensioned tie-rods extending between said clamping plates and axially through said roller body, and said tie-rods being adapted to draw said clamping plates together to place said roller body under axial stress;

each said tie-rod passing through said roller body at a respective different angular position around said roller body than the other said tie-rods, and said tie-rods being spaced radially away from the axis of said roller body, whereby said plates are drawn toward each other at different angular positions around said plates and said roller body.

2. The roller of claim 1, wherein said roller body has a peripheral surface and said tie-rods are relatively near to said peripheral surface of said roller body, as compared with their nearness to the axial center of said roller body.

3. A stone pressure roller for a paper making machine comprising:

a cylindrical roller body comprised of stone; said roller body having opposite axial ends;

a respective clamping plate positioned at each said axial end of said roller body;

a plurality of tensioned tie-rods extending between said clamping plates and axially through said roller body, and said tie-rods being adapted to draw said clamping plates together to place said roller body under axial stress; each of said tie-rods being covered by a protective covering which resists abrasion of the said tie-rod in said roller body; and each said tie-rod passing through said roller body at a respective different angular position around said roller body than the other said tie-rods, and said tie-rods being spaced radially away from the axis of said roller body, whereby said plates are drawn toward each other at different angular positions around said plates and said roller body.

4. A stone pressure roller for a paper making machine comprising:

a cylindrical roller body comprised of stone; said roller body having opposite axial ends;

a respective clamping plate positioned at each said axial end of said roller body;

a plurality of tensioned tie-rods extending between said clamping plates and axially through said roller body, and said tie-rods being adapted to draw said clamping plates together to place said roller body under axial stress; each of said tie-rods being convered by a protective covering which resists abrasion of the said tie-rod in said roller body;

said roller body having a peripheral surface and said tie-rods being relatively near to said peripheral surface of said roller body, as compared with their nearness to the axial center of said roller body; and each said tie-rod passing through said roller body at a respective different angular position around said roller body than the other said tie-rods, and said tie-rods being spaced radially away from the axis of said roller body, whereby said plates are drawn toward each other at different angular positions around said plates and said roller body.

5. A stone pressure roller for a paper making machine comprising:

a cylindrical roller body comprised of stone; said roller body having opposite axial ends;

a respective clamping plate positioned at each said axial end of said roller body;

a plurality of tensioned tie-rods extending between said clamping plates and axially through said roller body, and said tie-rods being adapted to draw said clamping plates together to place said roller body under axial stress;

each said tie-rod passing through said roller body at a respective different angular position around said roller body than the other said tie-rods, and said tie-rods being spaced radially away from the axis of said roller body, whereby said plates are drawn toward each other at different angular positions around said plates and said roller body; and said roller body being provided with a bore hole means comprising at least one axial bore hole extending longitudinally through said body; said tie-rods extending through said roller body by extending through said bore hole means.

6. A stone pressure roller for a paper making machine comprising:

a cylindrical roller body comprised of stone; said roller body having opposite axial ends;

a respective clamping plate positioned at each said axial end of said roller body;

a plurality of tensioned tie-rods extending between said clamping plates and axially through said roller body, and said tie-rods being adapted to draw said clamping plates together to place said roller body under axial stress;

said roller body having a peripheral surface and said tie-rods being relatively near to said peripheral surface of said roller body, as compared with their nearness to the axial center of said roller body;

each said tie-rod passing through said roller body at a respective different angular position around said roller body than the other said tie-rods, and said tie-rods being spaced radially away from the axis of said roller body, whereby said plates are drawn toward each other at different angular positions around said plates and said roller body; and said roller body being provided with a bore hole means comprising at least one axial bore hole extending longitudinally through said body; said tie-rods extending through said roller body by extending through said bore hole means.

7. The roller of claim 5 or 6, wherein said roller body is comprised of a plurality of separate, aligned, axially successive parts and said borehole means extends through all said parts to said clamping plates.

8. The roller of claim 7, wherein said roller body parts are each provided on axial ends thereof with complementary fitting surfaces, whereby said roller body parts will interfit with and engage each other and be held in a desired radial position with respect to each other by said complementary fitting surfaces.

9. The roller of claim 5 or 6, wherein said borehole means comprises one axial borehole through which said tie-rods extend and being of large enough cross-section for said tie-rods to be spaced away from the axis of said roller body.

10. The roller of claim 9, wherein in said borehole, said tie-rods are embedded in filler material.

11. The roller of claim 5 or 6, wherein said borehole means comprises a plurality of said axial boreholes, with a respective said axial borehole being provided for each said tie-rod and each said tie-rod extending between said clamping plates through the respective said borehole therefor.

12. The roller of claim 11, wherein each said borehole is relatively nearer said peripheral surface of said roller body than to said axis thereof and each said borehole is substantially parallel to the axis of said roller body.

13. The roller of claim 11, wherein said roller body is comprised of a plurality of separate, aligned, axially successive parts and said boreholes extend through all said parts to said clamping plates.

14. The roller of claim 13, wherein said roller body parts are each provided on axial ends thereof with complementary fitting surfaces, whereby said roller body parts will interfit with and engage each other and be held in a desired radial position with respect to each other by said complementary fitting surfaces.

15. The roller of claim 13, wherein in said boreholes said tie-rods are embedded in filler material.

16. The roller of claim 15, wherein said filler material comprises concrete.

17. The roller of claim 16, wherein each said tie-rod is covered by a protective covering, which resists abrasion of the said tie-rod in its said boreholes.

18. The roller of claim 5 or 6, wherein in said borehole means, said tie-rods are embedded in filler material.

19. The roller of claim 18, wherein said filler material comprises concrete.

20. The roller of claim 19, wherein each said tie-rod is covered by a protective covering, which resists abrasion of the said tie-rod in said borehole means.

21. The roller of claim 5 or 6, wherein said roller body, between said clamping plates, is comprised of a single stone element.

22. The roller of claim 11, wherein said roller body, between said clamping plates, is comprised of a single stone element.

* * * * *